US009237789B2

(12) United States Patent
Prehodka

(10) Patent No.: US 9,237,789 B2
(45) Date of Patent: Jan. 19, 2016

(54) HAIR DRYER SYSTEMS AND METHODS AND ATTACHMENTS FOR SUCH HAIR DRYER SYSTEMS

(76) Inventor: Barry V Prehodka, Ridgefield, CT (US)

( * ) Notice: Subject to any disclaimer, the term of this patent is extended or adjusted under 35 U.S.C. 154(b) by 25 days.

(21) Appl. No.: 13/046,281

(22) Filed: Mar. 11, 2011

(65) Prior Publication Data

US 2011/0277335 A1 Nov. 17, 2011

Related U.S. Application Data

(60) Provisional application No. 61/312,825, filed on Mar. 11, 2010.

(51) Int. Cl.
*A45D 20/12* (2006.01)
*A45D 20/10* (2006.01)

(52) U.S. Cl.
CPC ..... *A45D 20/12* (2013.01); *A45D 20/10* (2013.01); *A45D 20/122* (2013.01); *A45D 20/124* (2013.01)

(58) Field of Classification Search
CPC ... A45D 20/12; A45D 20/122; A45D 20/124; A45D 20/10
USPC ..... 34/96, 97, 98, 101
See application file for complete search history.

(56) References Cited

U.S. PATENT DOCUMENTS 3,288,375 A * 11/1966 Conover ..... 239/332
3,840,030 A * 10/1974 Baker ..... 132/118
5,054,211 A 10/1991 Shulman
5,161,317 A 11/1992 McDougall
5,235,759 A 8/1993 Rizzuto, Jr.
5,271,160 A 12/1993 Greiner et al.
5,462,018 A * 10/1995 Louison ..... 119/626
5,471,763 A 12/1995 McArthur
5,572,800 A 11/1996 West
5,628,123 A 5/1997 Chan
5,649,370 A 7/1997 Russo
5,689,896 A 11/1997 Smetana
5,729,907 A 3/1998 Santhouse et al.
5,761,824 A 6/1998 Moon et al.
5,765,292 A 6/1998 Chan
5,839,451 A * 11/1998 Dorber et al. ..... 132/271
5,956,863 A * 9/1999 Allen ..... 34/97
6,003,239 A * 12/1999 Liebenthal et al. ..... 34/97
6,094,837 A 8/2000 Cantor
6,222,988 B1 4/2001 Behrendt et al.
6,775,922 B2 * 8/2004 Langley et al. ..... 34/96
6,889,445 B1 * 5/2005 Varona et al. ..... 34/97
6,895,975 B2 5/2005 Hafemann
6,922,909 B2 8/2005 Andrew et al.
7,047,660 B2 * 5/2006 Leventhal ..... 34/97
7,412,781 B2 8/2008 Mattinger et al.
8,066,017 B1 11/2011 Born et al.
8,081,873 B2 12/2011 Dannenberg et al.
2004/0047620 A1 3/2004 Ruben (Continued)

*Primary Examiner* — Kenneth Rinehart
*Assistant Examiner* — Gajanan M Prabhu
(74) *Attorney, Agent, or Firm* — Ohlandt, Greeley, Ruggiero & Perle, LLP

(57) ABSTRACT

A hair dryer system includes a hair dryer connectable to a power source and having a power connection, an attachment that is connectable to the power connection and is supplied power from the power source by the power connection. When the hair dryer is connected to the attachment by the power connection, the hair dryer and attachment consume a predetermined amount of power. When the hair dryer is disconnected from the attachment, the hair dryer consumes less power than the predetermined amount of power.

14 Claims, 12 Drawing Sheets

(56) References Cited

U.S. PATENT DOCUMENTS

2005/0108889 A1 5/2005 Leventhal
2008/0116753 A1* 5/2008 Carlucci ..... 310/50
2008/0236604 A1* 10/2008 Mourad ..... 132/118
2009/0019719 A1* 1/2009 Yde et al. ..... 34/96

* cited by examiner

VACUUM ATTACHMENT

TURBO FAN ATTACHMENT

Power Dryer Liquid Dispenser Pic

Gel Liquifier Pic

HAIR DRYER SYSTEMS AND METHODS AND ATTACHMENTS FOR SUCH HAIR DRYER SYSTEMS

CROSS REFERENCE TO RELATED PATENT APPLICATIONS

This application claims the benefit of U.S. Provisional Application No. 61/312,825, filed Mar. 11, 2010. U.S. Provisional Application No. 61/312,825, filed Mar. 11, 2010 is hereby incorporated herein by reference in its entirety.

BACKGROUND OF THE INVENTION

1. Field of the Invention

This disclosure relates to hair dryer systems having a hair dryer and one or more removable powered attachments connected to the hair dryer in which the attachment and hair dryer draw power from a power source below a predetermined value of power, and when the hair dryer is disconnected from the attachment, the hair dryer has a reduced power draw than when connected to the attachment. This disclosure also relates to powered attachments that provide additional functionality to such hair dryer systems.

2. Description of the Related Art

Commercially available hair dryers typically have the maximum Underwriters Laboratories (UL) rating of 1875 Watts. Accordingly, these hair dryers are unable to use attachments that draw additional power because the hair dryer and attachment will exceed the maximum UL rating. Furthermore, most hair dryers that have a rating of 1875 Watts undesirably generate unneeded heat that must be reduced prior to contact of the heated air to a user to maintain safety and comfort and meet the safety requirements of agencies such as UL. Thus, these hair dryers consume more power than needed to dry hair effectively thereby leading to great inefficiency. Further, attachments that do not consume power limit the functionality of the attachment.

Accordingly, there is a need to provide hair dryer systems and methods that may be used with one or more powered attachments that reduce power consumption when the attachment is disconnected as compared to when the attachment is connected. There is a further need for powered attachments that provide the additional functionality to the hair dryer system such as vacuum, straightening, accelerating airflow, detangling hair, dispensing liquid hair products, ionizing, or any combinations thereof.

SUMMARY OF THE INVENTION

The present disclosure provides a hair dryer system that includes a hair dryer connectable to a power source, and also provides its own additional power connection and an attachment connectable to the dryer's power connection. The attachment is supplied power from the power source via the power connection. When the hair dryer is connected to the attachment via the power connection, the hair dryer and attachment consume less than a predetermined amount of power. When the hair dryer is disconnected from the attachment, the hair dryer consumes less power than the predetermined amount of power. When connected electrically and physically, the attachments may be controlled by a switch either on the attachment or on the dryer.

An attachment is provided that generates a vacuum during a drying action. The attachment includes a housing having an inlet aperture that receives pressured air generated by the hair dryer that flows through the housing and exits the housing through one or more openings to dry hair, a power connection on the housing connectable to a mating connection on the hair dryer, an impeller in the housing for generating a vacuum drawing air into the housing through a suction inlet to pick up hair off a user's head and for exhausting the air out of the housing through an exhaust vent, and a motor that consumes power to rotate the vacuum impeller.

An attachment for a hair dryer can also be provided that can straighten hair during or after the drying process. The attachment includes a housing having an inlet aperture that receives pressured air generated by the hair dryer which pressurized air flows through the housing and exits the housing through one or more openings to dry hair, a plate connected to the housing, a power connection on the housing connectable to a mating connection on the hair dryer, a heater that consumes power to heat the plate, and a plurality of projections forming a comb connected to the housing that direct hair into contact with the heated plate.

An attachment for a hair dryer can also be provided that increases airflow of the hair dryer. The attachment includes a housing having an inlet aperture that receives pressured air generated by the hair dryer, a power connection on the housing connectable to a mating connection on a hair dryer, an impeller in the housing for generating pressure to accelerate the pressured air from the hair dryer out of the housing through one or more openings to dry hair, and a motor that consumes power to rotate the impeller.

An attachment for a hair dryer can also be provided that can detangle hair. The attachment includes a housing having an inlet aperture that receives pressured air generated by the hair dryer that flows through the housing and exits the housing through one or more openings to dry hair, a power connection on the housing connectable to a mating connection on a hair dryer, a projection extending from the housing, and a motor that consumes power to move the projection from side-to-side to detangle hair during the drying process.

An attachment for a hair dryer can also be provided that can dispense liquid to the hair. The attachment includes a housing having an inlet aperture that receives pressured air generated by the hair dryer that flows through the housing and exits the housing through one or more openings to dry hair, a power connection on the housing connectable to a mating connection on a hair dryer, a reservoir holding a liquid, and a motor that consumes power to pump the liquid out of the reservoir.

An attachment for a hair dryer can also be provided that can liquefy and dispense hair products. The attachment includes a housing having an inlet aperture that receives pressured air generated by the hair dryer that flows through the housing and exits the housing through one or more openings to dry hair, a power connection on the housing connectable to a mating connection on a hair dryer, a holder that holds a material that is in a solid form at ambient temperatures, and a heater that consumes power to heat the material to transform the material from a solid to a liquid and dispense the material to a user's hair and/or scalp.

An ionizer attachment for a hair dryer can also be provided. The attachment includes a housing having an inlet aperture that receives pressured air generated by the hair dryer that flows through the housing and exits the housing through one or more openings to dry hair, a power connection on the housing connectable to a mating connection on a hair dryer, and an ionizer that consumes power to generate ions.

A method for power consumption of a hair dryer system can also be provided. The method includes connecting a hair dryer to a power source, connecting an attachment to a power connection on the hair dryer to supply power from the power source to the attachment via the power connection, and supplying power to the hair dryer that is connected to the attachment via the power connection below a predetermined amount of power.

The above-described and other advantages and benefits of the present disclosure will be appreciated and understood by those skilled in the art from the following detailed description, drawings, and appended claims.

DETAILED DESCRIPTION OF THE INVENTION

Figure 1:
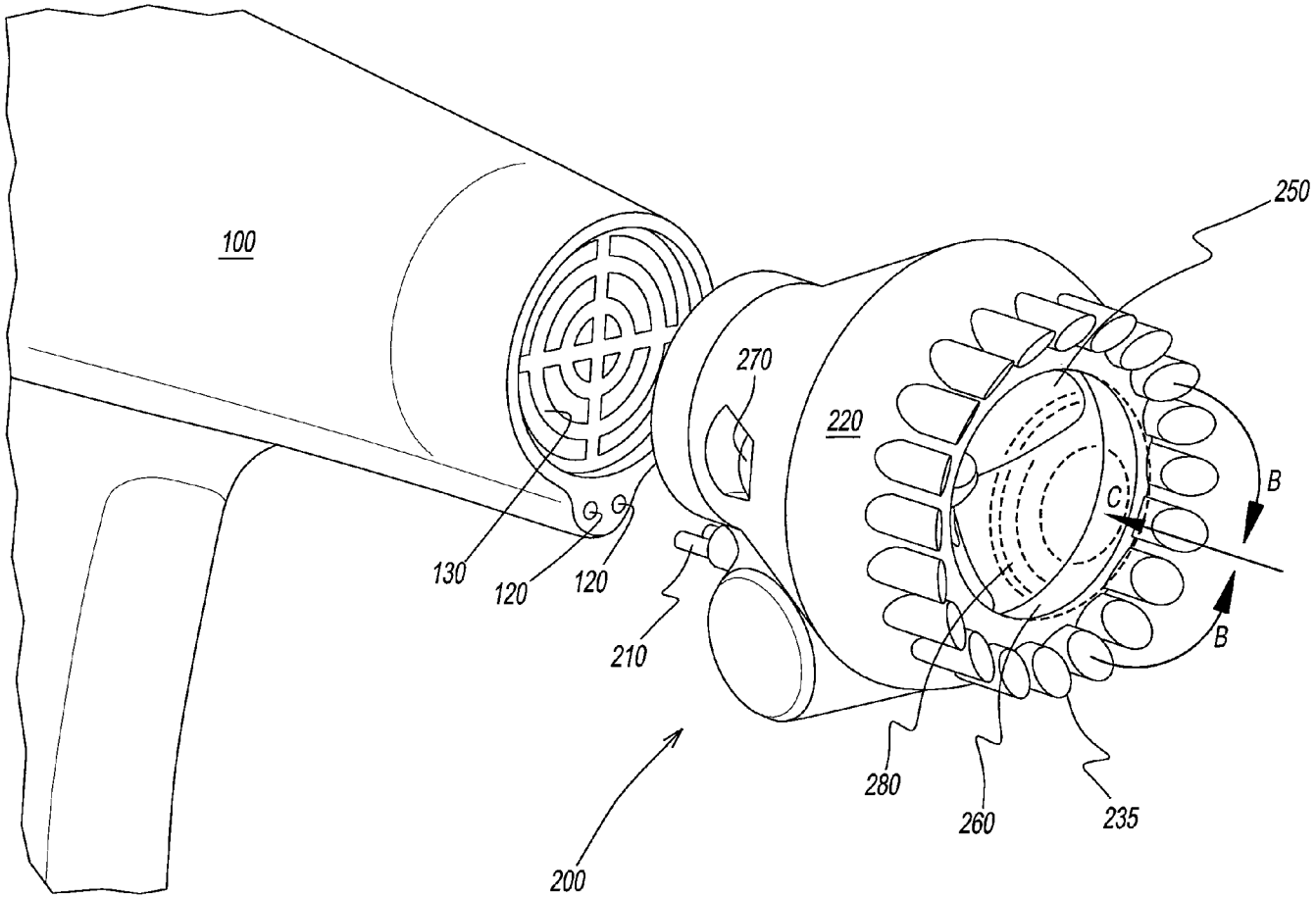
FIG. 1 is a front perspective view of a hair dryer and a suction attachment of the present disclosure.

Referring to the drawings and, in particular, to FIG. 1, an exemplary embodiment of a hair dryer according to the present disclosure generally represented by reference numeral 100 is shown. Hair dryer 100 is connectable to a power source 110. Hair dryer 100 draws power from power source 110 to generate positive air pressure and dispense air therethrough to dry hair as is known in the art.

Advantageously, hair dryer 100 has a power connection 120 that electrically connects an attachment 200 to hair dryer 100. The attachment 200 draws power from power source 110 through power connection 120 of hair dryer 100. For example, power source 110 is an outlet socket in a wall that conducts electricity to power connection 120, which in turn conducts electricity to the attachment 200. Alternatively, a switch (not shown) on the body of hair dryer 100 selectively connects current to connected vacuum attachment 200. The switch may be on the attachment 200 to selectively receive current from hair dryer 100.

When hair dryer 100 is electrically connected to the attachment 200 via power connection 120, hair dryer 100 and attachment 200 consume less than a predetermined amount of power. Preferably, the predetermined amount of power is less than the maximum power consumption allowed under the Underwriters Laboratory test, UL 859, of 1875 rated Watts. The maximum power for rated voltage is set at 1875 Watts. Underwriters Laboratories allows some tolerances when projecting a listed wattage rating. Tolerances given for voltage is up to 125 Volts. There is also a total wattage variation of up to an additional 10 percent over actual tested wattage. For example, a hair dryer running at 120 Volts producing an actual measured 1650 Watts is ratable at 1875 Watts at 125 Volts. However, temperature output of a hair dryer is limited by Underwriters Laboratories.

When hair dryer 100 is disconnected from the attachment 200, the hair dryer consumes less power, such as 20 percent less, than when the hair dryer 100 is connected to the attachment 200 while still providing equal or similar performance, e.g. providing similar heat and air flow. Preferably, hair dryer 100 alone has an Underwriters Laboratory rating of about 1500 Watts to about 1600 Watts when the attachment 200 is disconnected. Also, preferably, the attachment 200 has a power consumption under the Underwriters Laboratory test of 275 Watts. Therefore, when hair dryer 100 is connected to the attachment, power consumption is less than an Underwriters Laboratory rating of 1875 Watts and the hair dryer still has a desirable Underwriters Laboratory rating of 1875 Watts.

Referring now to FIGS. 1 through 4, an exemplary embodiment of a vacuum attachment generally represented by reference numeral 200 is shown. Vacuum attachment 200 is electrically connectable to power connection 120 of hair dryer 100 by a second power connection 210. Second power connection 210 may have parallel prongs and power connection 120 may be adjacent holes having the same spacing as the prongs; however, power connections 120, 210 may be any connection to conduct or transfer power from hair dryer 100 to attachment 200. Power connections 120, 210 may be on the surface of the hair dryer, or within the outlet or nozzle of the hair dryer.

Figure 2:
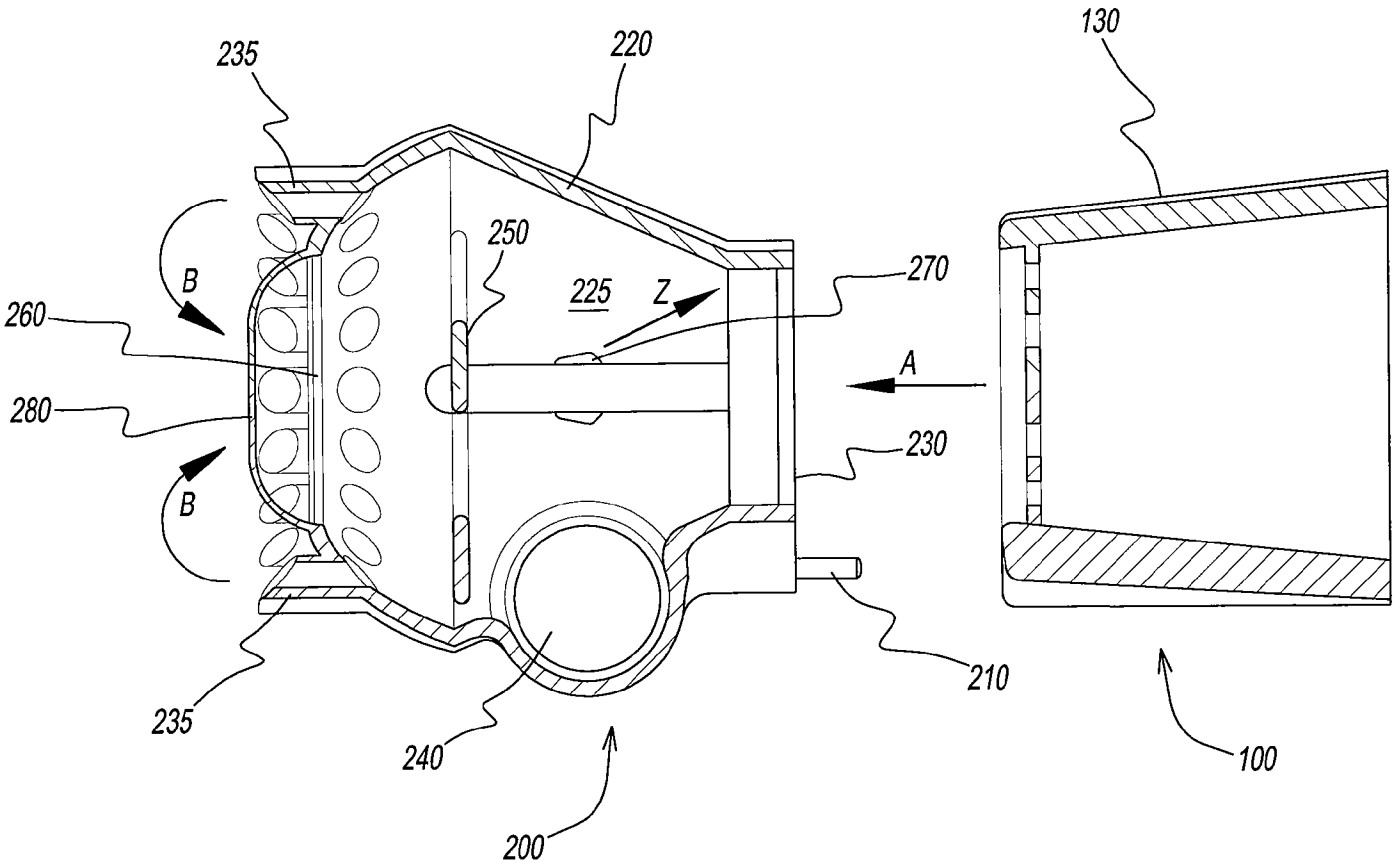
FIG. 2 is a cross-section of FIG. 1.
Figure 3:
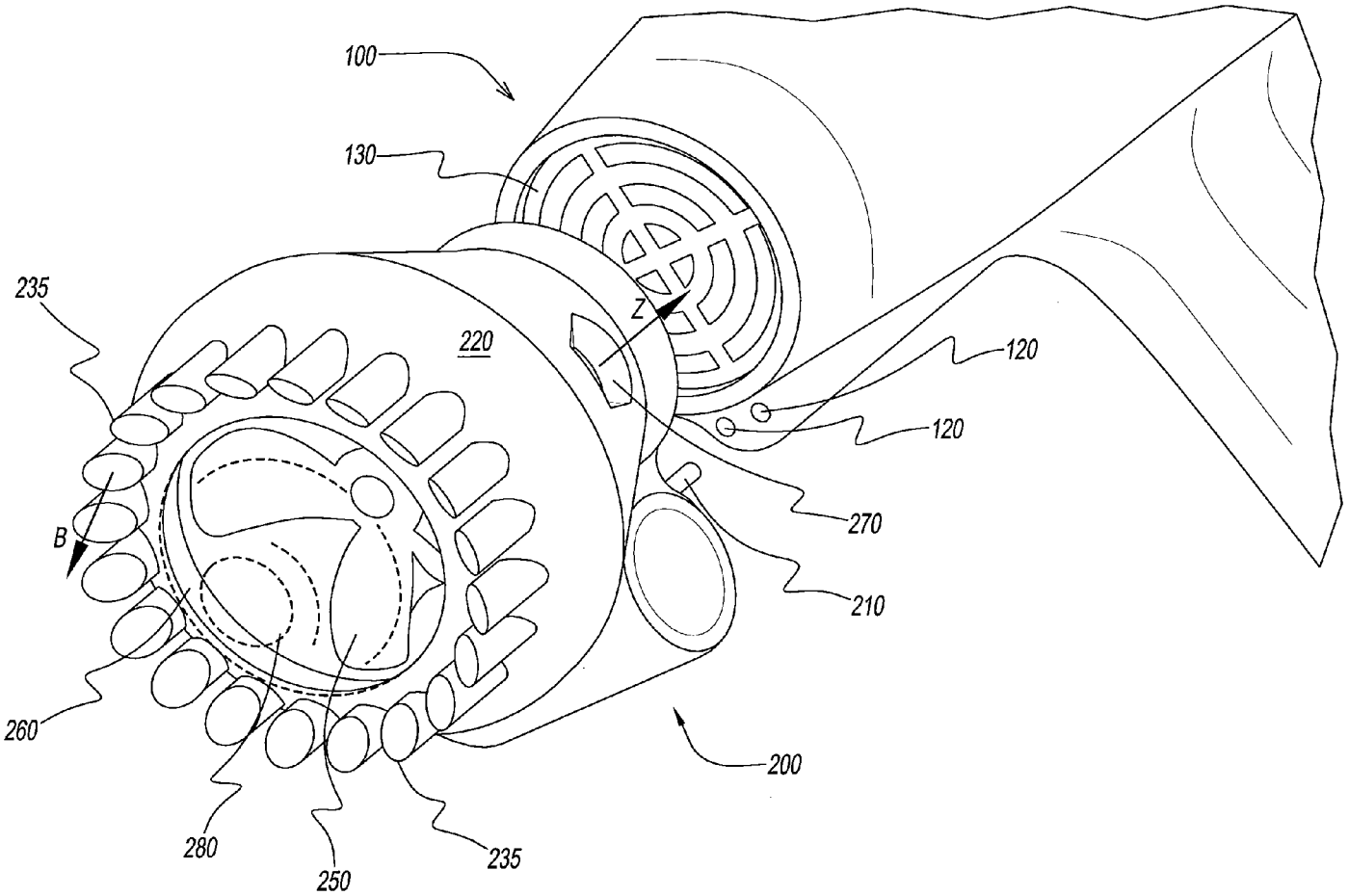
FIG. 3 is an enlarged front perspective view of FIG. 1.
Figure 4:
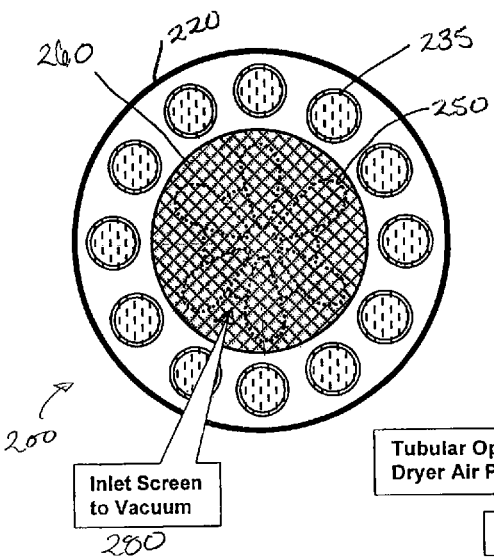
FIG. 4 is a schematic front view of a suction attachment.

Vacuum attachment 200 has a housing 220 having an inlet aperture 230, as shown in FIG. 2. Housing 220 is connectable to hair dryer 100 so that inlet aperture 230 is in fluid communication with a nozzle 130, as shown in FIG. 2, of hair dryer 100 to receive pressured heated air generated by hair dryer 100 therethrough. The pressured air flows out of hair dryer 100, as represented by arrow A shown in FIG. 2, into vacuum attachment 200 through inlet aperture 230 when vacuum attachment 200 is connected to nozzle 130. The pressured air A flows through housing 220 and exits housing 220 through one or more tubes 235, as represented by arrow B in FIG. 5, to blow pressured, heated air onto a user's hair. Tubes 235 may have an angular cut so as to bias airflow towards center.

Figure 5:
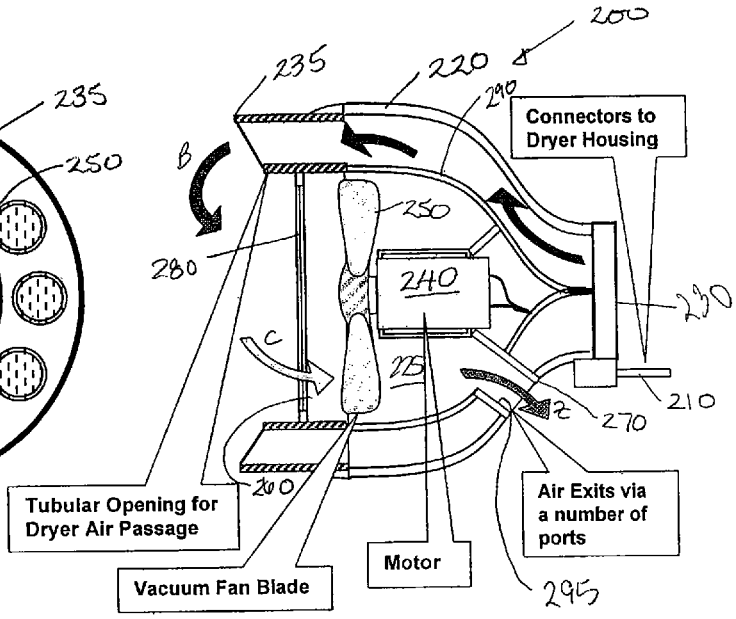
FIG. 5 is a schematic cross-sectional view of FIG. 4.

Vacuum attachment 200 has a motor 240, shown schematically in FIGS. 2 and 5, in housing 220. Motor 240 draws power from power source 110 through power connections 120, 210. Motor 240 selectively rotates impeller 250. Motor 240 rotates impeller 250 to create a vacuum or suction drawing air into housing 220, as shown by arrow C in FIG. 5. Motor 240 rotates impeller 250 to evacuate a center portion 225 and exhaust air out of the housing 220 through one or more exhaust vents 270, as shown by arrow Z. Thus, outside air is drawn into housing 220 through vacuum inlet aperture 260, past inlet screen 280, past impeller 250, and exits housing 220 through exhaust vent 270.

Housing 220 may have a dryer air duct 290 molded in housing 220, as shown in FIG. 5. Dryer air duct 290 isolates a first airflow A, shown in FIG. 5, of pressured air generated from hair dryer 100 from a second airflow Z of pressured air generated by impeller 250 within center portion 225 of housing 220. Housing 220 may have one or more vent air ports 295 molded in housing 220 to exhaust air through exhaust vent 270. Vent air port 295 exhausts the second airflow Z of pressured air generated by impeller 250 so that the first airflow A of pressured air generated from hair dryer 100 is isolated from the second air flow Z being exhausted through exhaust vent 270. Vacuum inlet aperture 260 may be covered, for example, by a screen 280, to prevent hair from being drawn into housing and becoming tangled with impeller 250. Motor 240 may be any motor that can rotate an impeller in housing 220.

It has been determined that hair dryer 100 generating positive pressured and heated air A, without vacuum attachment 200, blows hair flat against a user's head so that hair was forced on top of each other causing difficulty in drying, and flattening hair against a user's head. Advantageously, impeller 250 of vacuum attachment 200 applies pressured air B toward a user's head and draws hair away from a user's head to dry the hair while blowing the positive pressure air A on this drawn hair. Thus, hair may be more efficiently dried by more completely surrounding hair with pressured and heated air and more volume may be imparted to hair by drawing hair away from a user's head during the drying process.

Figure 6:
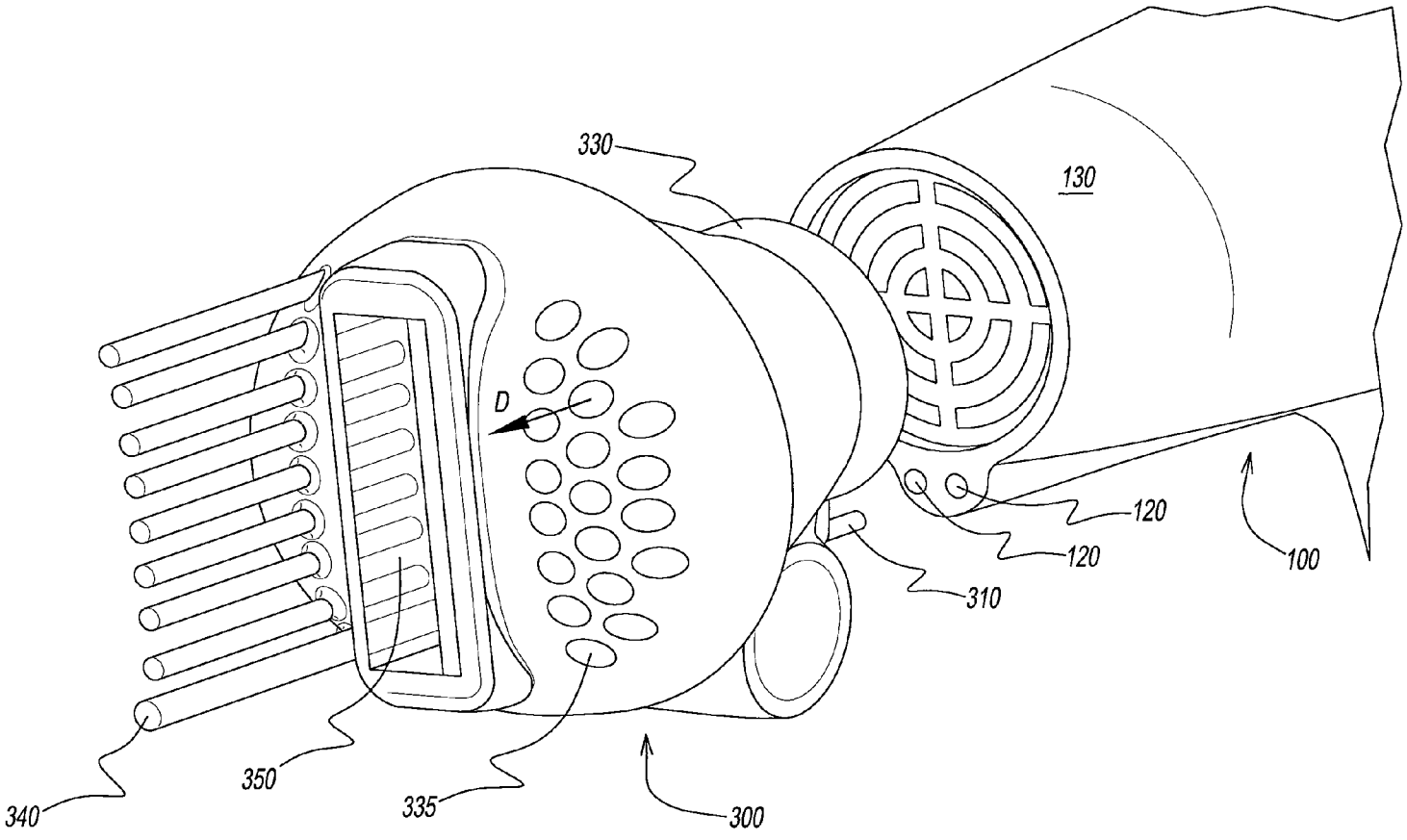
FIG. 6 is a front perspective view of the hair dryer and a straightening attachment of the present disclosure.
Figure 7:
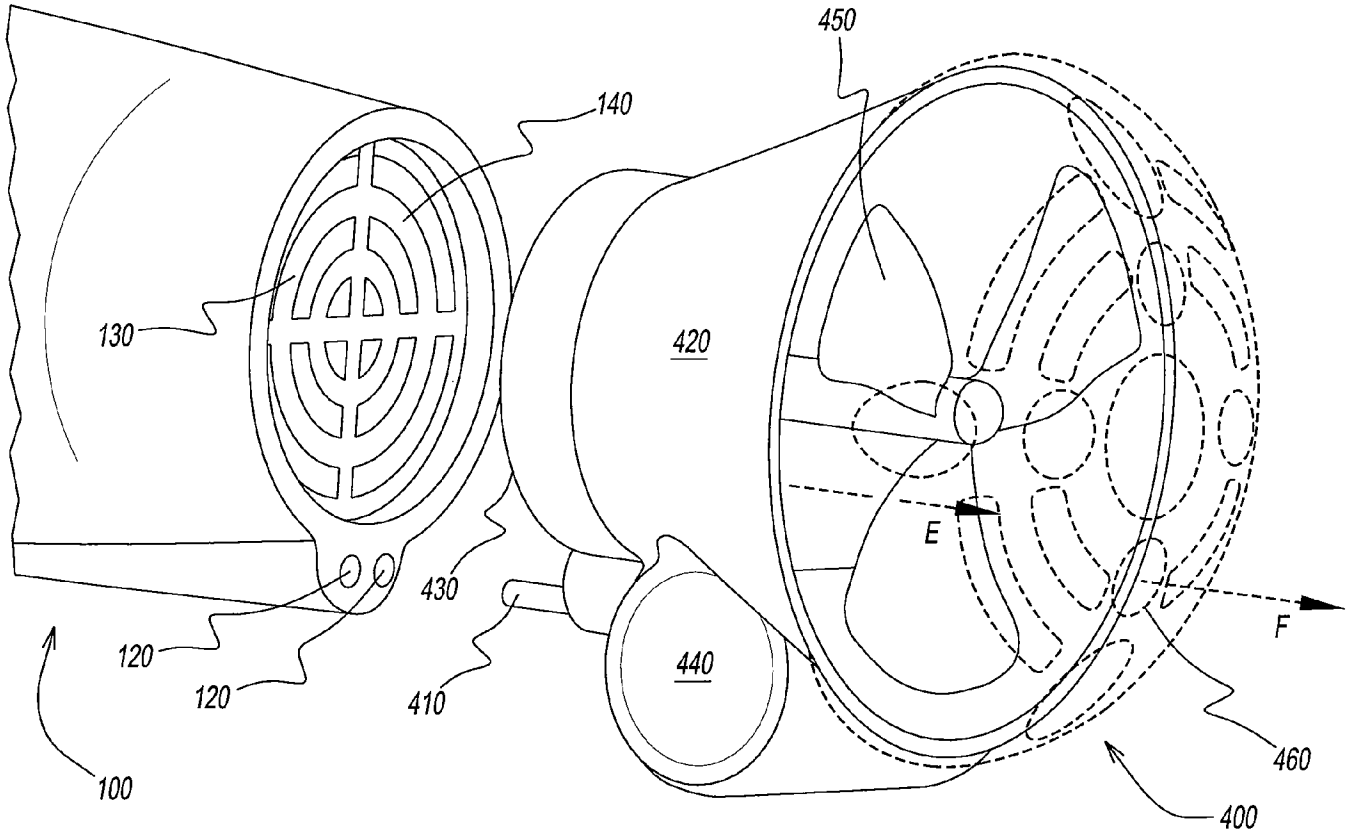
FIG. 7 is a side perspective view of the hair dryer and an air accelerator attachment of the present disclosure.
Figure 8:
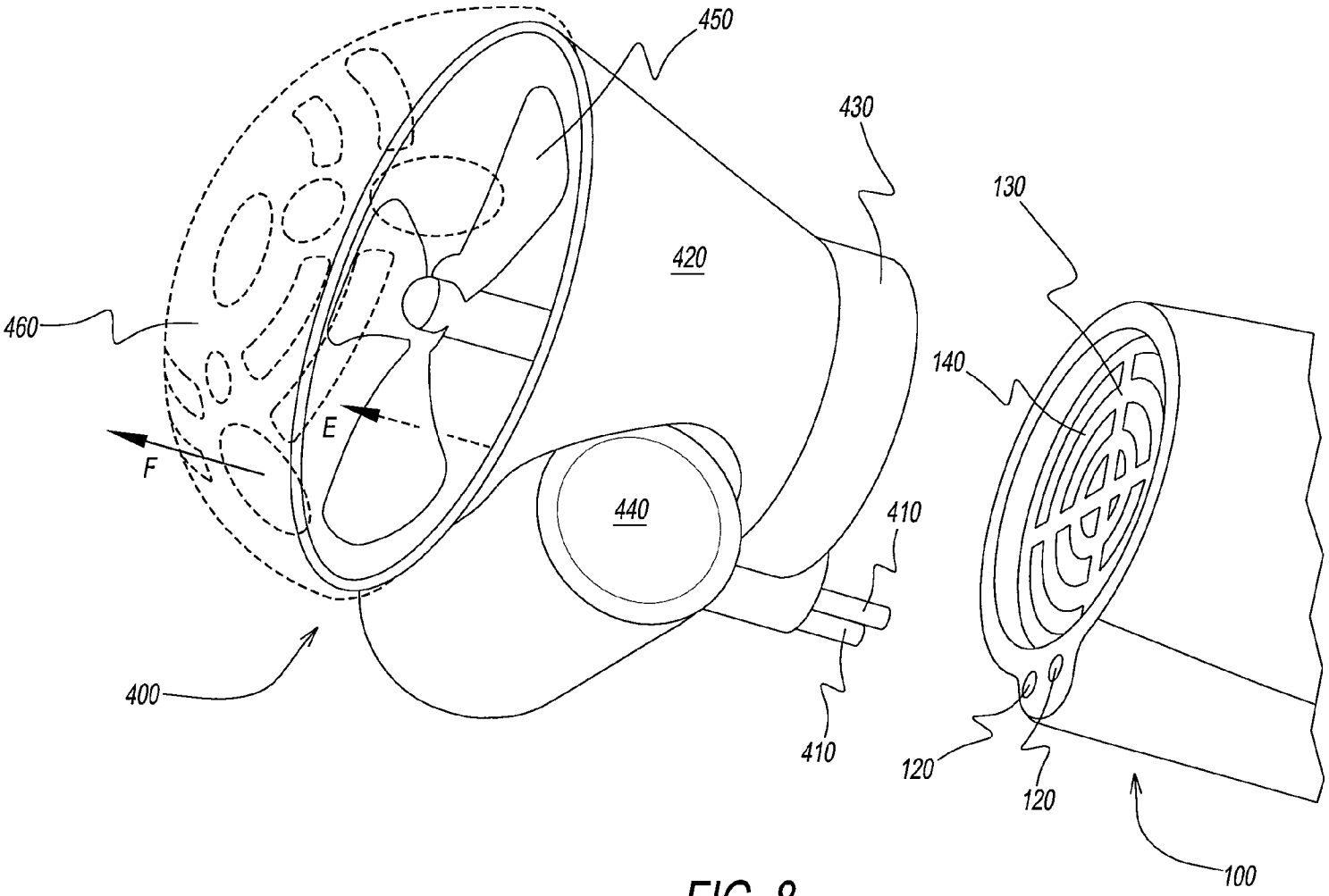
FIG. 8 is an enlarged front perspective view of FIG. 7.
Figure 9:
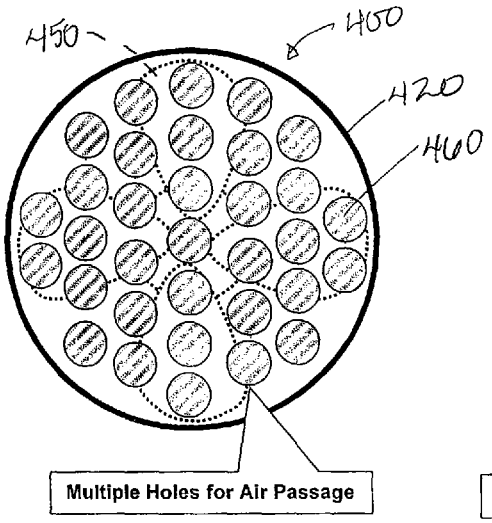
FIG. 9 is a schematic front view of an accelerator attachment.
Figure 10:
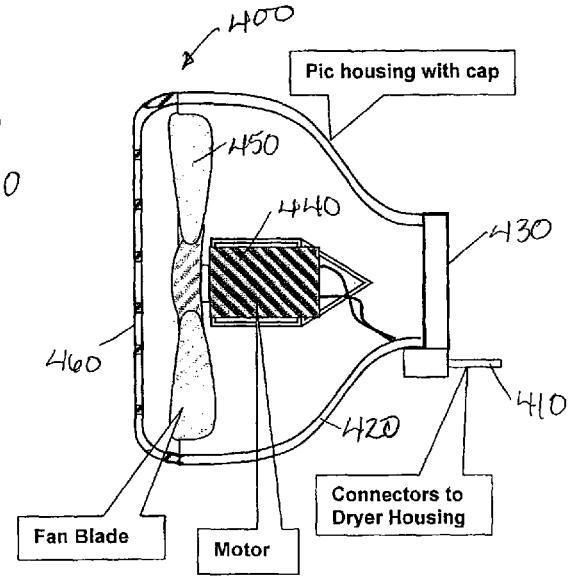
FIG. 10 is a schematic cross-sectional view of FIG. 9.

Referring to FIG. 6, an exemplary embodiment of a straightening attachment generally represented by reference numeral 300 is shown. Straightening attachment 300 is electrically connectable to power connection 120 of hair dryer 100 by an attachment power connection 310. Attachment power connection 310 is shown as parallel prongs, and power connection 120 is shown as adjacent holes having the same spacing as the prongs. However, power connections 120, 310 may be any connection to transfer power from hair dryer 100 to attachment 300.

Straightening attachment 300 has an attachment housing 320 with an attachment inlet aperture 330. Attachment housing 320 is connectable to hair dryer 100 so that attachment inlet aperture 330 is in fluid communication with a nozzle 130 of hair dryer 100 to receive positive pressured, heated air generated by hair dryer 100 therethrough. The positive pressured air flows out of hair dryer 100 into straightening attachment 300 when straightening attachment is connected to nozzle 130. The positive pressured air flows through attachment housing 320 and exits housing 320 through one or more holes 335, as represented by arrow D shown in FIG. 6, to blow positive pressured and heated air onto a user's hair.

Attachment housing 320 has projections 340 that may brushed through a user's hair forming a comb. Housing 320 has a straightening plate 350 that may be selectively heated. A heater (not shown) is positioned in housing 320 and/or plate 350. The heater draws power from power source 110 through attachment power connections 120, 310. The heater heats straightening plate 350. Straightening plate 350 is positioned next to projections 340 so that hair traverses projections 340 that provide the hair with tension to pull the hair straight as that straight hair is moved across heated plate 350 and dried by air blowing through one or more holes 335. It is contemplated by the present disclosure for holes 335 to be positioned before plate 350, through plate 350, after plate 350, and any combinations thereof. The heater may be any heater that heats straightening plate 350, such as, for example, a resistance wire heater, positive temperature coefficient (PTC) heater, or other known electrical heating source. Straightening plate may be a metal plate, a ceramic plate having heater therein, epoxy, ceramic coated metal, a painted metal plate, or any combinations thereof.

Referring to FIGS. 7 through 10, an exemplary embodiment of an accelerator attachment generally represented by reference numeral 400 is shown. Accelerator attachment 400 is connectable to power connection 120 of hair dryer 100 by an accelerator power connection 410. Accelerator power connection 410 is shown as parallel prongs and power connection 120 is shown as adjacent holes having the same spacing as the prongs. However, power connections 120, 410 may be any connection to transfer power from hair dryer 100 to attachment 400.

Accelerator attachment 400 has an accelerator housing 420 with an accelerator inlet aperture 430. Accelerator housing 420 is connectable to hair dryer 100 so that accelerator inlet aperture 430 is in fluid communication with a nozzle 130 of hair dryer 100 to receive positive pressured air generated by hair dryer 100 therethrough.

The positive pressured air flows out of hair dryer 100 into accelerator attachment 400 when accelerator attachment is connected to nozzle 130. The positive pressured air flows into accelerator housing 420. Similar to vacuum attachment 200 described above, accelerator attachment 400 has an accelerator motor 440, shown schematically in FIGS. 7, 8, and 10, in accelerator housing 420. Accelerator motor 440 draws power from power source 110 through accelerator power connections 120, 410. Accelerator motor 440 selectively rotates an accelerator impeller 450. Accelerator motor 440 rotates accelerator impeller 450 to accelerate air in accelerator housing 420, as shown by arrow E in FIGS. 7 and 8, out of accelerator housing 420 through one or more vents 460, as shown by arrow F. Accelerator motor 440 may be any motor that can rotate an impeller within accelerator housing 420.

It has been determined by the present disclosure that air in hair dryer 100 air is slowed down by, such as, for example, vented safety plate 140 at nozzle 130 and/or by being blow across heating elements (not shown) within the dryer. Further, it has been determined by the present disclosure that it is undesirable to place a fan and motor in hair dryer 100 downstream of the heating coil in the dryer due to the required distance the fan and motor must be from the heating coil. Thus, it has been determined by the present disclosure that flow of air out of hair dryer 100 is slowed and not laminar, which reduces the drying capacity of the dryer. Advantageously, accelerator attachment 400 accelerates, or re-accelerates, air and creates a more laminar flow from hair dryer 100 for more efficient, quicker drying over hair dryers without accelerator attachment 400.

Figure 11:
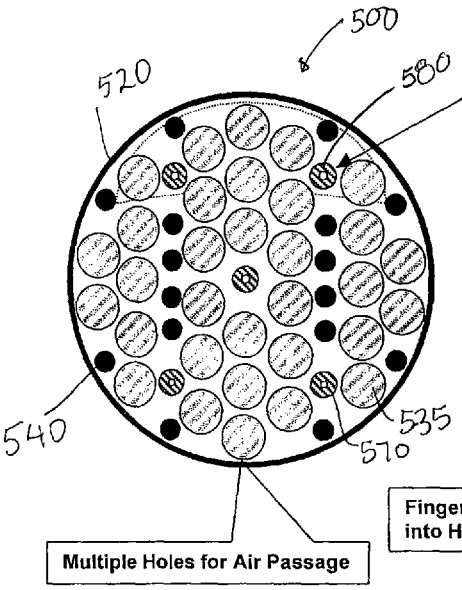
FIG. 11 is a schematic front view of a dispenser attachment of the present disclosure.
Figure 12:
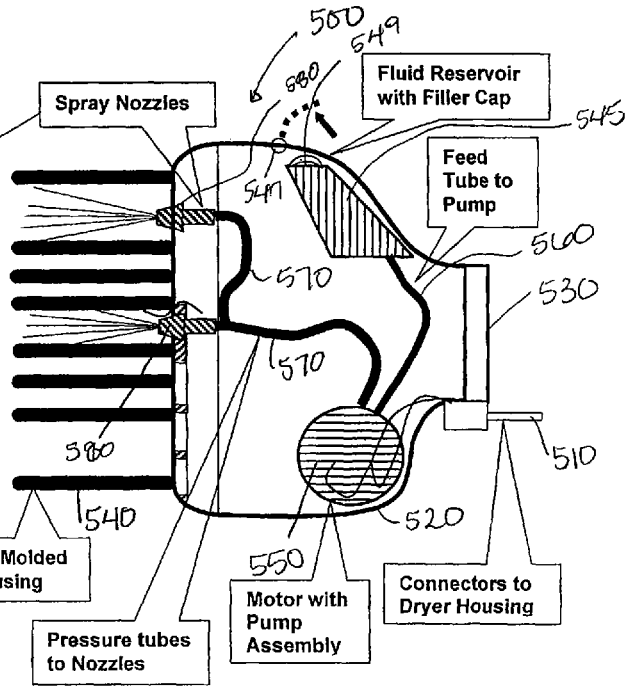
FIG. 12 is a schematic cross-sectional view of FIG. 11.

Referring to FIGS. 11 and 12, an exemplary embodiment of a dispenser attachment generally represented by reference numeral 500 is shown. Dispenser attachment 500 is electrically connectable to a power connection, for example power connection 120 of hair dryer 100 shown in FIG. 1, by a dispenser power connection 510. Dispenser power connection 510 is shown as parallel prongs; however, power connections 120, 510 may be any connection to transfer power from hair dryer 100 to attachment 500.

Dispenser attachment 500 has a dispenser housing 520 with a dispenser inlet aperture 530. Dispenser housing 520 is connectable to a hair dryer, such as, for example, hair dryer 100 shown in FIG. 1, so that dispenser inlet aperture 530 is in fluid communication with a nozzle, for example, nozzle 130 of hair dryer 100 shown in FIG. 1, to receive positive pressured, heated air generated by the hair dryer. The positively pressured air flows through dispenser inlet aperture 530, through dispenser housing 520, and out of housing 520 through air passage holes 535.

Dispenser housing 520 has projections or fingers 540 that may brushed through a user's hair forming a comb. Dispenser housing 520 has a reservoir 545 that holds fluid. Reservoir 545 may have a filler aperture 547 so that reservoir may be filled with fluid through filler aperture into filler cap 549. Filler aperture 547 may have a cover, shown in dotted lines in FIG. 12, that may be lifted up and away from reservoir 545 exposing an opening in reservoir 545 to fill reservoir 545 with fluid.

A motor pump assembly 550, shown schematically in FIG. 12, is positioned in dispenser housing 520. Motor pump assembly 550 draws power from a power source, for example, power source 110 shown in FIG. 1, through power connection 120, 510. Motor pump assembly 550 forces fluid in reservoir 545 through a feed tube 560 to motor pump assembly 550. Motor pump assembly 550 pumps the fluid through one or more pressure tubes 570 to one or more spray nozzles 580 to dispense the fluid out of dispenser housing 520 onto a user's hair and/or scalp. Fluid may be selectively dispensed from nozzles 580 before, during and/or after air generated by the hair dryer flows out of air passage holes 535. Motor pump assembly 550 may be any motor that can move fluid from reservoir 545 out of spray nozzles 580. The fluid may be conditioner, hair gel, or any other fluid hair product.

Dispenser attachment 500 may have one or more switches (not shown) for selectively dispensing the fluid onto a user's hair and/or scalp. The one or more switches may be on dispenser attachment and/or hair dryer 100.

Figure 13:
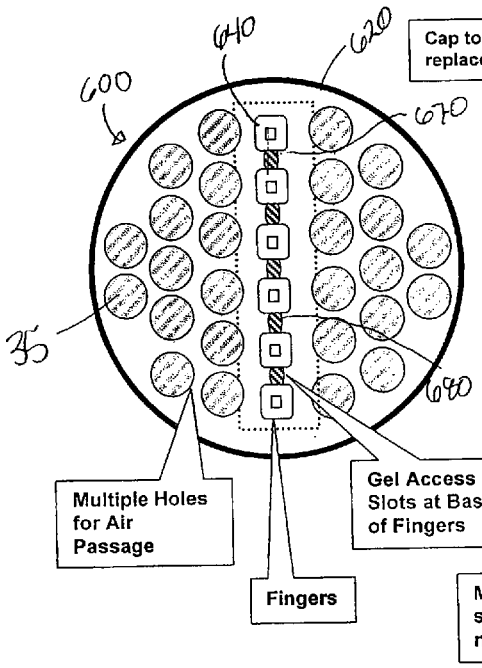
FIG. 13 is a schematic front view of a liquifier attachment of the present disclosure.
Figure 14:
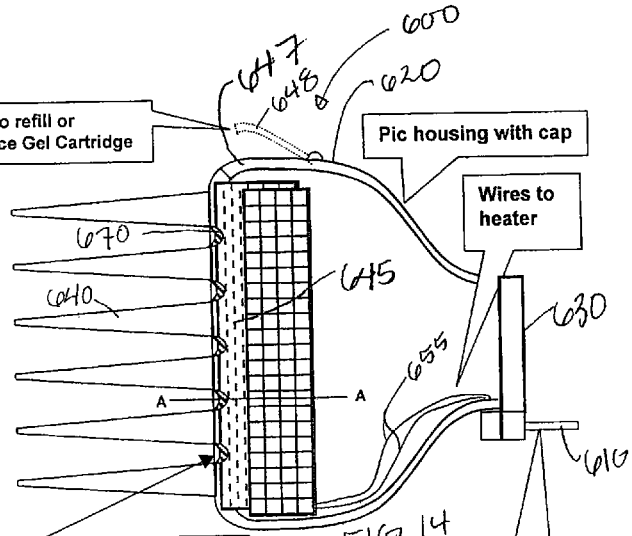
FIG. 14 is a schematic cross-sectional view of FIG. 13.
Figure 15:
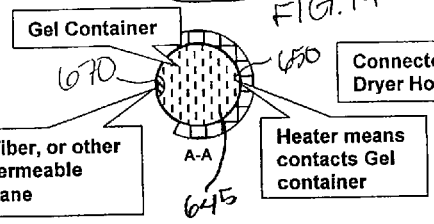
FIG. 15 is a schematic partial side cross-section view taken along line A-A of FIG. 14.

Referring to FIGS. 13 through 15, an exemplary embodiment of a liquifier attachment generally represented by reference numeral 600 is shown. Liquifier attachment 600 is connectable to a power connection, for example power connection 120 of hair dryer 100 shown in FIG. 1, by a liquifier power connection 610. Liquifier power connection 610 is shown as parallel prongs. However, power connections 120, 610 may be any connection to transfer power from a hair dryer to attachment 600.

Liquifier attachment 600 has a liquifier housing 620 with a liquifier inlet aperture 630. Liquifier housing 620 is connectable to a hair dryer, such as, for example, hair dryer 100 shown in FIG. 1, so that liquifier inlet aperture 630 is in fluid communication with a nozzle, for example, nozzle 130 of hair dryer 100, to receive positive pressured air generated by the hair dryer. The positively pressured and heated air flows through liquifier inlet aperture 630, through liquifier housing 620, and out of liquifier housing 620 through holes 635.

Liquifier housing 620 has a container 645. Container 645 holds a material that is solid at ambient temperature, such as, for example, 23 degrees Celsius, and a liquid when heated, such as, for example, heated to about 55 to about 90 degrees Celsius.

A material heater 650, shown schematically in FIG. 15, is positioned in thermal communication with container 645 to transfer heat from material heater 650 to the material. Material heater 650 draws power from a power source, for example, power source 110 shown in FIG. 1, through power connections 120, 610. Material heater 650 draws power from a power source, such as, for example, through one or more wires 655. Material heater 650 communicates heat to the material so that material is melted from solid to liquid form. A regulating device, such as a thermostat, may be used to regulate temperature of the container and its contents.

Liquifier housing 620 has projections or fingers 640 that may be brushed through a user's hair forming a comb. Fingers 640 are positioned adjacent one another so that an access slot 670 is formed between two adjacent fingers 640. Access slots 670 may be formed by mesh, fiber, or other semi-permeable membrane positioned between adjacent fingers 640. When the material is in liquid form, the material is dispensed through membrane 680 due to the force of gravity and/or capillary action of the membrane onto a user's hair and/or scalp. The material may be dispensed before, during and/or after air generated by the hair dryer flows out of holes 635.

Liquifier housing 620 may have an aperture 647 that can be accessed through a cover 648 so that the material can be placed in container 645. The material may be in a cartridge in solid form. The material in container 645 may be conditioner, hair gel, or any other fluid hair product. Either the container may be replaced in its entirety, or a reusable container may be refilled.

Liquifier attachment 600 is shown by way of example only, for dispensing the melted material through membrane 680 due to the force of gravity and/or capillary action of the membrane. However, it is also contemplated by the present disclosure for liquifier attachment 600 to include a pump as described with respect to dispenser attachment 500. Furthermore, it is contemplated by the present disclosure for dispenser attachment 500 to include a heater as described with respect to liquifier attachment 600 to heat the liquid material therein.

Figures 16, 17:
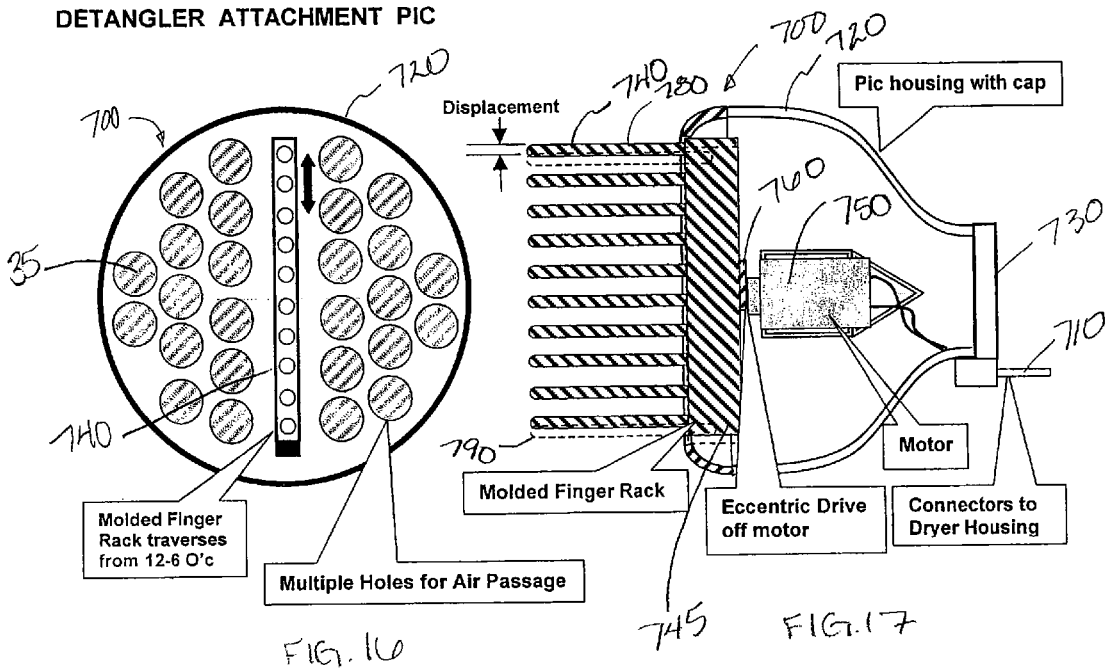
FIG. 16 is a schematic front view of a detangler attachment of the present disclosure.
FIG. 17 is a schematic cross-sectional view of FIG. 16.

Referring to FIGS. 16 and 17, an exemplary embodiment of a detangler attachment generally represented by reference numeral 700 is shown. Detangler attachment 700 is connectable to a power connection, for example power connection 120 of hair dryer 100 shown in FIG. 1, by a detangler power connection 710. Detangler power connection 710 is shown as parallel prongs. However, power connections 120, 710 may be any connection to transfer power from a hair dryer to attachment 700.

Detangler attachment 700 has a detangler housing 720 with a detangler inlet aperture 730. Detangler housing 720 is connectable to a hair dryer, such as, for example, hair dryer 100 shown in FIG. 1, so that detangler inlet aperture 730 is in fluid communication with a nozzle, for example, nozzle 130 of hair dryer 100 shown in FIG. 1, to receive positive pressured, heated air generated by the hair dryer. The positively pressured air flows through detangler inlet aperture 730, through detangler housing 720, and out of housing 720 through air holes 735.

Detangler housing 720 has projections or detangler fingers 740 that brush through a user's hair forming a comb. Detangler fingers 740 may be connected, for example, molded together, on a finger rack 745 so that movement of finger rack 745 moves all of detangler fingers 740.

A motor assembly 750, shown schematically in FIG. 17, is positioned in detangler housing 720. Motor assembly 750 draws power from a power source, for example, power source 110 shown in FIG. 1, through detangler power connection 710 and power connection, for example, power connection 120 shown in FIG. 1, of the hair dryer 100. Motor assembly 750 moves an eccentric drive 760 connected to motor assembly 750 from side-to-side. Eccentric drive 760 is connected to finger rack 745 to move finger rack 745 and fingers 740 from side-to-side, such as, from a first position 780 shown in FIG. 17 to a second position 790 shown in dotted lines in FIG. 17. Movement of fingers 740 may be before, during and/or after air generated by the hair dryer flows out of air holes 735. Motor assembly 750 may be any motor that can move fingers 745 from side-to-side.

Movement of fingers 745 from side-to-side as fingers are moved through hair separates or detangles hair. Separation or detangling of hair prevents or eliminates knots or tangles in a user's hair. Another fixed set of fingers may also be incorporated into the housing for enhanced detangling. If the fingers were replaced with cutting blades, such an arrangement would create a hair clipping attachment for the dryer.

Figure 18:
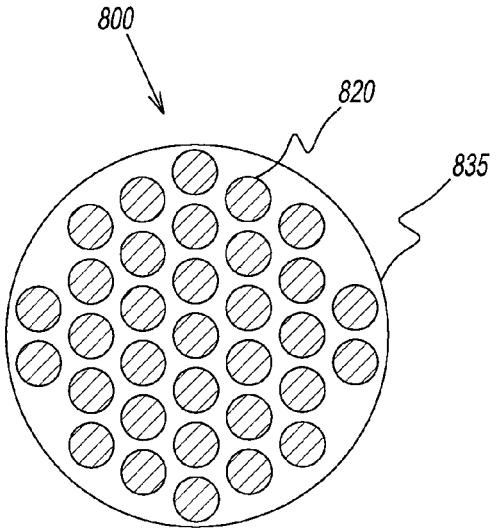
FIG. 18 is a schematic front view of an ionizer attachment of the present disclosure.
Figure 19:
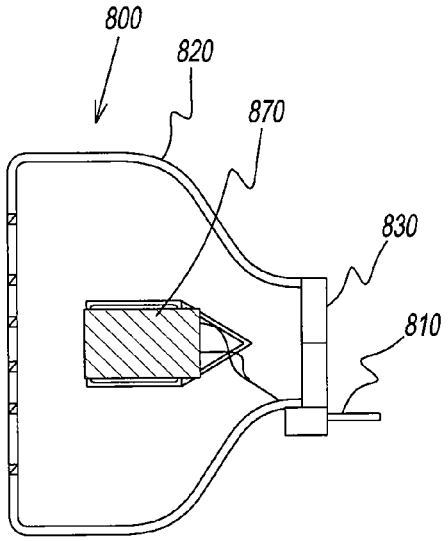
FIG. 19 is a schematic cross-sectional view of FIG. 18.

Referring to FIGS. 18 and 19, an ionizing attachment 800 may also be used with hair dryer 100 shown in FIG. 1 in place of the illustrated vacuum attachment 200. The ionizing attachment 800 is connectable to a power connection, for example power connection 120 of hair dryer 100 shown in FIG. 1, by an ionizing power connection 810. The ionizing power connection 810 may have parallel prongs; however, the power connections may be any connection to transfer power from a hair dryer to the attachment.

The ionizing attachment has a housing 820 with an inlet aperture 830. The ionizing housing 820 is connectable to a hair dryer, such as, for example, hair dryer 100 shown in FIG. 1, so that aperture 830 is in communication with a nozzle, for example, nozzle 130 of hair dryer 100 shown in FIG. 1, to receive positive pressured air generated by the hair dryer. The positively pressured air flows through inlet aperture 830, through the housing 820, and out of housing through air holes 835.

An ionizer 870 is positioned in the housing 820. The ionizer 870 draws power from a power source, for example, power source 110 shown in FIG. 1, through the ionizing power connector 810 and power connection, for example, power connection 120 shown in FIG. 1, of the hair dryer 100. The ionizer 870 generates ions dispensed to a user's hair. The ionizer 870 may generate ions before, during and/or after air generated by the hair dryer flows out of air holes. The ionizer 870 may be any ionizer that can dispense ions to a user's hair. Preferably, ionizer 870 produces negative ions.

The attachments described above may have housings made of thermally resistant plastic known for dryer applications, such as polypropylene and polycarbonate. It is further contemplated by the present disclosure that because the attachments described above have their own power connection, the attachments may be used remote or not in fluid communication with the hair dryer, for example, with a complimentary power cord. In addition, for example, any of the attachments described herein may have a separate corded plug for use independently without hair dryer 100, such as, for example, as a mini dryer or straightener.

Combinations of the above individual stated functions can also be combined to create many feature matrixes. For example, an attachment may include one or more functions described herein, such as, an attachment that has both vacuum and an ionizer as described above for vacuum attachment 200 and ionizing attachment 800.

While the instant disclosure has been described with reference to one or more exemplary embodiments, it will be understood by those skilled in the art that various changes may be made and equivalents may be substituted for elements thereof without departing from the scope thereof. In addition, many modifications may be made to adapt a particular situation or material to the teachings of the disclosure without departing from the scope thereof. Therefore, it is intended that the disclosure not be limited to the particular embodiment(s) disclosed as the best mode contemplated for carrying out this invention, but that the invention will include all embodiments falling herein.

What is claimed is:

1. A hair dryer system comprising:

a hair dryer;

a plurality of attachments each being connectable to said hair dryer, each of said plurality of attachments has a housing with an inlet aperture receiving pressured heated air generated by the hair dryer, wherein the pressured heated air flows through said housing and exits said housing through an outlet on a side of said housing, said plurality of attachments each being connectable to a power connection on the hair dryer so that when the hair dryer is connected to a power source current is selectively connected to said attachment of said plurality of attachments that is connected to said hair dryer; and wherein when each of said plurality of attachments is connected to the hair dryer via said power connection, the hair dryer and said attachment of said plurality of attachments that is connected to said hair dryer consume less than a predetermined amount of power of 1875 Watts at 125 Volts, and when each of said plurality of attachments is disconnected from the hair dryer, the hair dryer consumes less power than said predetermined amount of power, and wherein each of said plurality of attachments has a power consumption of less than 275 Watts, wherein said power is consumed by a device selected from the group consisting of a motor rotating an impeller inside said housing, a second motor moving a plurality of fingers from side-to-side outside said housing, a pump inside said housing that pumps fluid outside of said housing, a heater inside said housing, and any combinations thereof, wherein one of said plurality of attachments has said impeller in said housing for generating a vacuum drawing air into said housing through a suction inlet and exhausting said air out of the housing through an exhaust vent, and wherein said one of said plurality of attachments has an air duct in said housing that isolates a first airflow generated from the hair dryer from a second airflow generated from said impeller.

2. The hair dryer system of claim 1, wherein one of said plurality of attachments has said second motor moving said plurality of fingers from side-to-side outside said housing.

3. The hair dryer system of claim 2, wherein said plurality of projections form a comb and said outlet is a plurality of openings, and wherein said plurality of openings are on opposite sides of said comb.

4. A hair dryer system comprising:

a hair dryer;

a plurality of attachments each being connectable to said hair dryer, each of said plurality of attachments has a housing with an inlet aperture receiving pressured heated air generated by the hair dryer, wherein the pressured heated air flows through said housing and exits said housing through an outlet on a side of said housing, said plurality of attachments each being connectable to a power connection on the hair dryer so that when the hair dryer is connected to a power source current is selectively connected to said attachment of said plurality of attachments that is connected to said hair dryer; and wherein when each of said plurality of attachments is connected to the hair dryer via said power connection, the hair dryer and said attachment of said plurality of attachments that is connected to said hair dryer consume less than a predetermined amount of power of 1875 Watts at 125 Volts, and when each of said plurality of attachments is disconnected from the hair dryer, the hair dryer consumes less power than said predetermined amount of power, and wherein each of said plurality of attachments has a power consumption of less than 275 Watts, wherein said power is consumed by a device selected from the group consisting of a motor rotating an impeller inside said housing, a second motor moving a plurality of fingers from side-to-side outside said housing, a pump inside said housing that pumps fluid outside of said housing, a heater inside said housing, and any combinations thereof, wherein one of said plurality of attachments has a plate connected to an outer surface of said housing of said one of said plurality of attachments so that said heater heats said plate.

5. The hair dryer system of claim 4, wherein said outer surface of said housing has a plurality of projections forming a comb, and wherein said plate is between said outlet and said plurality of projections.

6. A hair dryer system comprising:

a hair dryer;

a plurality of attachments each being connectable to said hair dryer, each of said plurality of attachments has a housing with an inlet aperture receiving pressured heated air generated by the hair dryer, wherein the pressured heated air flows through said housing and exits said housing through an outlet on a side of said housing, said plurality of attachments each being connectable to a power connection on the hair dryer so that when the hair dryer is connected to a power source current is selectively connected to said attachment of said plurality of attachments that is connected to said hair dryer; and wherein when each of said plurality of attachments is connected to the hair dryer via said power connection, the hair dryer and said attachment of said plurality of attachments that is connected to said hair dryer consume less than a predetermined amount of power of 1875 Watts at 125 Volts, and when each of said plurality of attachments is disconnected from the hair dryer, the hair dryer consumes less power than said predetermined amount of power, and wherein each of said plurality of attachments has a power consumption of less 275 Watts, wherein said power is consumed by a device selected from the group consisting of a motor rotating an impeller inside said housing, a second motor moving a plurality of fingers from side-to-side outside said housing, a pump inside said housing that pumps fluid outside of said housing, a heater inside said housing, and any combinations thereof, wherein one of said plurality of attachments has said motor and said impeller in said housing for generating pressure to accelerate said pressured air from the hair dryer out of said housing through one or more openings through said housing, wherein said inlet of said housing is a single inlet and said housing is continuous from said single inlet to said outlet, wherein said housing only has a single air flow therein from said single inlet to said outlet, and wherein said impeller accelerates only said single airflow upstream of said impeller from said single inlet to downstream of said impeller out of said housing through said outlet.

7. The hair dryer system of claim 6, wherein said inlet aperture is upstream of said impeller and said one or more openings are downstream of said impeller.

8. A hair dryer system comprising:

a hair dryer;

a plurality of attachments each being connectable to said hair dryer, each of said plurality of attachments has a housing with an inlet aperture receiving pressured heated air generated by the hair dryer, wherein the pressured heated air flows through said housing and exits said housing through an outlet on a side of said housing, said plurality of attachments each being connectable to a power connection on the hair dryer so that when the hair dryer is connected to a power source current is selectively connected to said attachment of said plurality of attachments that is connected to said hair dryer; and wherein when each of said plurality of attachments is connected to the hair dryer via said power connection, the hair dryer and said attachment of said plurality of attachments that is connected to said hair dryer consume less than a predetermined amount of power of 1875 Watts at 125 Volts, and when each of said plurality of attachments is disconnected from the hair dryer, the hair dryer consumes less power than said predetermined amount of power, and wherein each of said plurality of attachments has a power consumption of less 275 Watts, wherein said power is consumed by a device selected from the group consisting of a motor rotating an impeller inside said housing, a second motor moving a plurality of fingers from side-to-side outside said housing, a pump inside said housing that pumps fluid outside of said housing, a heater inside said housing, and any combinations thereof, wherein one of said plurality of attachments has said pump inside said housing that pumps fluid outside of said housing.

9. The hair dryer system of claim 8, wherein said one attachment has a reservoir connected to said housing that holds said fluid, and said pump pumps said fluid out of said reservoir.

10. The hair dryer system of claim 9, wherein said housing has a nozzle therethrough, and wherein said reservoir is in said housing and said pump pumps said fluid out of said reservoir through said nozzle.

11. The hair dryer system of claim 10, wherein said nozzle is adjacent said outlet.

12. A hair dryer system comprising:

a hair dryer;

a plurality of attachments each being connectable to said hair dryer, each of said plurality of attachments has a housing with an inlet aperture receiving pressured heated air generated by the hair dryer, wherein the pressured heated air flows through said housing and exits said housing through an outlet on a side of said housing, said plurality of attachments each being connectable to a power connection on the hair dryer so that when the hair dryer is connected to a power source current is selectively connected to said attachment of said plurality of attachments that is connected to said hair dryer; and wherein when each of said plurality of attachments is connected to the hair dryer via said power connection, the hair dryer and said attachment of said plurality of attachments that is connected to said hair dryer consume less than a predetermined amount of power of 1875 Watts at 125 Volts, and when each of said plurality of attachments is disconnected from the hair dryer, the hair dryer consumes less power than said predetermined amount of power, and wherein each of said plurality of attachments has a power consumption of less 275 Watts, wherein said power is consumed by a device selected from the group consisting of a motor rotating an impeller inside said housing, a second motor moving a plurality of fingers from side-to-side outside said housing, a pump inside said housing that pumps fluid outside of said housing, a heater inside said housing, and any combinations thereof, wherein one of said plurality of attachments has a holder that holds a material that is in a solid form at ambient temperatures, and said heater heats said material to transform said material from a solid to a liquid and dispenses said material from said housing.

13. The hair dryer system of claim 12, wherein said housing has a plurality of openings therethrough each covered by a membrane, and wherein said material is dispensed through said membrane.

14. The hair dryer system of claim 12, wherein said housing has a plurality of projections extending from an outer surface forming a comb and said outlet is a plurality of openings, and wherein each of said plurality of openings has one of said plurality of projections on opposite sides thereof and said plurality of openings are on opposite sides of said comb.

* * * * *